US005179750A

United States Patent [19]

Moussalli

[11] Patent Number: 5,179,750

[45] Date of Patent: Jan. 19, 1993

[54] METHOD FOR WARPING USING PROGRESSIVELY CONTROLLED TENSION ON A DYE BEAM

[76] Inventor: Francis S. Moussalli, 3508 Marlboro Ct., Charlottesville, Va. 22901

[21] Appl. No.: 659,539

[22] Filed: Feb. 22, 1991

Related U.S. Application Data

[63] Continuation of Ser. No. 540,317, Jun. 20, 1990, abandoned, which is a continuation of Ser. No. 421,115, Oct. 13, 1989, abandoned, which is a continuation of Ser. No. 265,767, Nov. 1, 1988, abandoned.

[51] Int. Cl.[5] ..... D06B 5/18; B65H 55/04; B65H 59/00

[52] U.S. Cl. ..... 8/155.1; 28/194; 68/198; 242/45; 242/176

[58] Field of Search ..... 242/18 R, 36, 45, 47, 242/147 R, 147 M, 149, 150 R, 150 M, 153, 154, 155 R, 155 M, 159, 176, 177, 178; 8/155, 155.1; 68/198; 28/194

[56] References Cited

U.S. PATENT DOCUMENTS

| | | | |
|---|---|---|---|
| 974,127 | 11/1910 | Daniell et al. | 8/155.1 X |
| 1,985,603 | 12/1934 | Elssner | 242/176 X |
| 2,190,797 | 2/1940 | Moncrieff et al. | 242/176 X |
| 2,637,993 | 5/1953 | Stienen | 68/198 |
| 3,433,432 | 3/1969 | Willis | 68/198 X |
| 4,059,239 | 11/1977 | Hori et al. | 242/45 X |
| 4,135,268 | 1/1979 | von der Eltz et al. | 8/155.1 |
| 5,046,673 | 9/1991 | Moussali | 242/18 R |

FOREIGN PATENT DOCUMENTS

| | | | |
|---|---|---|---|
| 511730 | 4/1955 | Canada | 8/155.1 |

OTHER PUBLICATIONS

"Muff Dyeing High Bulk Yarns of Orlon", Dupont Bulletin OR-122, Dec. 1961.

*Primary Examiner*—Philip R. Coe
*Attorney, Agent, or Firm*—Ronald P. Kananen

[57] ABSTRACT

A method and apparatus for winding yarn to produce a wound yarn package having a variable density profile. The variable density profile in the wound yarn is produced by variably tensioning the yarn during the winding process by an electrical apparatus which is responsive to a programmed control signal to provide variable tension on the yarn. The density profile thus produced is preferably a progressively variable density profile. In a preferred embodiment, the method is carried out with a precision winding machine with an electromagnetic tensioner. A controlled sequence of control signals is applied to the tensioner to provide a correspondingly varying tension on the yarn. The application of controlled tensioning to dyeing beams by progressively increasing tensioning warping yarn along the length of the beam has also shown improved results in resisting dye liquor channeling and blowout and permitted a beam geometry with a greater capacity.

6 Claims, 10 Drawing Sheets

| LAYER NUMBER | VOLUME (cm^3) | MASS (GRAMS) | DENSITY (g/dm^3) | DENSITY/ AVE. DEN. | PERCENT VOLUME | CUM % VOLUME |
|---|---|---|---|---|---|---|
| 1 | 815.90 | 236.50 | 289.86 | 0.82 | 23.02 | 23.02 |
| 2 | 1152.90 | 374.50 | 324.97 | 0.92 | 32.51 | 55.52 |
| 3 | 1576.60 | 645.30 | 409.30 | 1.15 | 44.48 | 100.00 |
| TOTALS | 3544.90 | 1256.30 | | | 100.00 | |
| AVERAGES | | | 359.40 | | | |

| | VOLTS | TENSION (GRAMS) | TIME (MINUTES) | VOLUME (cm^3) | MASS (GRAMS) | DENSITY (g/dm^3) |
|---|---|---|---|---|---|---|
| | 16.74 | 15 | 6.5 | 435.40 | 150.00 | 344.51 |
| | 24.6 | 30 | 12 | 834.00 | 320.00 | 383.69 |
| | 26.1 | 33 | 34 | 2234.70 | 876.00 | 392.00 |
| TOTALS | | | 52.5 | 3504.10 | 1346.00 | |
| AVERAGES | | | | | | 384.12 |

| | VOLTS | TENSION (GRAMS) | TIME (MINUTES) | VOLUME (cm^3) | MASS (GRAMS) | DENSITY (g/dm^3) |
|---|---|---|---|---|---|---|
| | 16.74 | 15 | 6.5 | 542.20 | 165.40 | 305.05 |
| | 24.6 | 25 | 12 | 853.80 | 304.60 | 356.76 |
| | 26.1 | 37 | 34 | 2135.20 | 879.80 | 412.05 |
| TOTALS | | | 52.5 | 3531.20 | 1349.80 | |
| AVERAGES | | | | | | 382.25 |

| | VOLTS | TENSION (GRAMS) | TIME (MINUTES) | VOLUME (cm^3) | MASS (GRAMS) | DENSITY (g/dm^3) |
|---|---|---|---|---|---|---|
| | 9.3-13.7 | 15-20 | 10 | 785.60 | 260.50 | 331.59 |
| | 15.2-17.5 | 25-35 | 15 | 1045.10 | 403.60 | 386.18 |
| | 18.6 | 38 | 27 | 1739.20 | 703.20 | 404.32 |
| TOTALS | | | 52 | 3569.90 | 1367.30 | |
| AVERAGES | | | | | | 383.01 |

FIG. 10A

| YARDS FROM CORE OF BEAM | LEFT | | CENTER | | RIGHT | | MAXIMUM DIFFERENCE ACROSS WIDTH (%) |
|---|---|---|---|---|---|---|---|
| | RUN 1 | RUN 2 | RUN 1 | RUN 2 | RUN 1 | RUN 2 | |
| 15 | 1.92 | 1.83 | 2.19 | 1.83 | 2.13 | 1.96 | 19.7 |
| 1000 | 1.88 | 1.60 | 2.12 | 1.94 | 1.92 | 1.90 | 32.5 |
| 1950 | 2.73 | 2.78 | 2.81 | 3.07 | 2.87 | 2.93 | 12.5 |

FIG. 10B

| YARDS FROM CORE OF BEAM | LEFT | | CENTER | | RIGHT | | MAXIMUM DIFFERENCE ACROSS WIDTH (%) |
|---|---|---|---|---|---|---|---|
| | RUN 1 | RUN 2 | RUN 1 | RUN 2 | RUN 1 | RUN 2 | |
| 15 | 2.03 | 2.04 | 2.08 | 2.07 | 2.09 | 2.09 | 3.0 |
| 1000 | 1.88 | 1.90 | 1.94 | 1.95 | 1.89 | 1.88 | 3.7 |
| 1950 | 2.00 | 2.01 | 2.09 | 2.11 | 2.02 | 2.04 | 5.5 |

METHOD FOR WARPING USING PROGRESSIVELY CONTROLLED TENSION ON A DYE BEAM

This application is a continuation of application Ser. No. 07/540,317, filed Jun. 20, 1990, now abandoned, which is a continuation of application Ser. No. 07/421,115, filed Oct. 13, 1989, now abandoned, which is a continuation of application Ser. No. 07/265,767, filed Nov. 1, 1988, now abandoned.

BACKGROUND OF THE INVENTION

This invention relates to a method and apparatus for controlled programmable electronic winding of yarn in the textile industry. More particularly, this invention relates to a method and apparatus for yarn winding in which the geometry of a yarn package is variably controlled electronically according to a predetermined program. Still more particularly, this invention relates to an automatic yarn winding system which is electronically programmable to achieve pre-programmed density profiles in a yarn package which are uniform in shape, density, and weight averages between take-up packages made of the same yarn. In another aspect, this invention relates to the application of such winding to warping for yarn dyeing on beams, to beams thus warped using such techniques, and to the novel geometry of dyeing beams made possible by such techniques.

In the textile industry, yarn is generally packaged for various steps in textile processing as a plurality of wraps of yarn disposed about a core. The ideal characteristics of a package of yarn usually depend upon the end use of the package and the characteristics of the yarn so that yarn packaged for weaving or warping may be packaged differently than yarn intended for dyeing. By way of example, a package of yarn for weaving should usually have a mild wrap angle about the core and the yarn-to-yarn friction should be minimized during unwinding. Such a weaving package should also usually be as heavy as possible and include a workable transfer tail in order to minimize labor. In contrast, a package of yarn destined to be dyed should be porous in order to allow the dye liquor to flow through the packaged yarn with a minimum of resistance and a resulting minimum loss of pressure. Thus, a number of machines and devices have been developed for winding yarn in such packages.

Generally, such winding machines have been of two types, i.e., conventional winding machines which generally include either a grooved drum or a cam guide for the yarn, and so-called precision winding machines which include a propeller driven with a constant wind ratio. A particularly suitable winder assembly wherein the winder is controlled primarily mechanically was available from Sharer Textile Machine Works, Ltd., Switzerland, which is now part of the SSM Corporation of Switzerland. In that winder, yarn from a supply package is provided through a mechanical tensioner which has a fixed tension to the propeller to be wound at a fixed, constant wind ratio on a package. To vary the wind ratio, a mechanical linkage having a swivel arm is adjusted. In addition, the back pressure on the yarn exhibited by the back pressure system of the machine can also be adjusted. However, such adjustments can only be made mechanically when the machine is not running, and there is no effective way to adjust the geometry of the wound package during operation. Such shortcomings are significant not only from a labor and production standpoint, but also from the viewpoint of the end use of the package.

For yarn dyeing, for example, a precision wound package is more likely to permit an easier flow of dye liquor from the interior of the core through the packaged yarn to the exterior of the yarn package than a random wound package of yarn. Unfortunately, even yarn packages which are precision wound using conventional techniques, such as by the Scharer winder, do not consistently produce a controllable density profile for the yarn package. In random winding, for example, the yarn is wound over the circumference of the support by tangential friction at an angle determined by the constant groove pattern in the drum. As the package diameter increases, the length of yarn delivered for a wrap also increases so that the distance along the support between the beginning and the end of a wrap must also increase to maintain the ratio constant. Therefore, so-called "ribbons" are formed when successive layers of yarn accumulate on top of or adjacent one another. The yarn density of such ribbons is higher than that of the package, thus interfering with liquor flow through the yarn mass during dyeing. While mechanical expedients have been tried with some success, the density of the yarn package is not readily mechanically controllable during random winding.

In contrast, during precision winding, package density near the core or support is quite low due to the slow starting speed of the winding machine, and then increases slightly as the package diameter increases. However, little attention is generally paid to package density because of the inconvenience and difficulty in mechanically adjusting the mechanical features of the winding machine as mentioned above.

The foregoing background is presented in the parent pending application mentioned above. Another problem which is assisted by the features of the invention relates to warping with progressively increasing tension between the inside and the outside of a dye beam. Yarns also commonly dyed on beams, especially for woven styling in fabrics that contain dyed yarns in the warp such as shirting materials, especially oxford fabrics, which usually consist of dyed yarn in the warp and greige yarns in the filling. Other fabrics that use beam dyed yarns are striped towels, mattress ticking, striped shirting, pajama fabrics, and all types of fabrics that are woven with jacquard patterns. Except for a few shades or styles, those fabrics are usually produced in short yardages, therefore requiring short manufacturing runs.

Dyeing on beams is economical when compared to dyeing in package form, as described above. However, the manufacturing sequence differs between package dyed yarns and beam dyed yarns. The package dyeing process consists of more production steps, which result in a higher cost for the finished product. Quite often, when preparing to weave short yardage, yarns have to be dyed on full-size packages and backwound onto smaller packages suitable for the length of yarn needed for the warp. The same condition applies when the stripes across the width of the fabric consist of a small number of ends. The total weight of these ends is relatively small, and the yarns are dyed on full-size packages and then backwound to a small number of packages. Backwinding is an added function; it also increases the hairiness of the yarn and the amount of wasted yarn.

It is a continuing problem in connection with the beam yarn dyeing industry to address the channeling of the dye liquor flow. This defect, generally referred to as a blow-up or blown beam, occurs when the dye liquor finds a less dense area of yarn and flows through that path of least resistance instead of flowing uniformly throughout the beam. In the main, little attention has been given to the problem of blown beams since the industry considers blown beams to be strictly a problem for the dyer to be solved in the dyehouse and not in the geometry of the beam itself. That blow-up of the beam is most likely to happen where the thread density factor is the lowest. The thread density factor is calculated by taking the square root of the number of ends divided by the cotton count.

In the art, a typical dye beam has the following construction characteristics: (1) an outside flange diameter of about 31 inches; (2) a core diameter of 23 inches; (3) a beam width of about 56 inches; and (4) a maximum yarn weight of 275 pounds. A striking feature of this geometry is the core diameter which leaves only four inches of radial distance for the yarn layer thickness. Despite this significant sacrifice in productivity, beams continue to blow, especially when they are made of two-ply yarns, as commonly used in toweling. Thus, a significant and continuing problem in the beam dyeing art is to improve productivity while not causing increases in beam blowout.

Thus, it is an overall objective of this invention to provide controlled electronic programmable winding for yarn packages. Such an invention would be useful to increase the productivity and the quality of yarn dyeing by controlling the density profile for the yarn package with favorable results. For example, a consequence of a low pressure drop across the yarn package during dyeing is that the yarn mass in the dyeing machine can be increased, thereby effectively increasing the yarn capacity and dyeing capacity of the dyeing machine. Moreover, the package geometry can be improvedly controlled according to the invention.

It is an additional overall objective of this invention to apply progressively increasing tension uniformly across the width of a warp on a beam to improve the process of beaming.

It is another general objective of this invention to provide a method for controlled electronically-programmed winding for packaging yarns.

It is still another objective of this invention to provide a method and apparatus for winding yarn according to a program implemented through an electronic apparatus to provide a predetermined density profile to the packaged yarn.

It is still another objective of this invention to provide a method and apparatus for winding yarn on a beam according to a program implemented through an electronic apparatus to provide a progressively increasing uniform tension across the width of the warp and to increase the tension gradually as more yarn is warped around the beam.

It is still another objective of this invention to provide a method and apparatus for controlling yarn package geometry by electrically controlling the tension on the yarn during winding according to a predetermined program to provide a particular geometry and density profile to the yarn package.

It is still another objective of this invention to provide a method and apparatus for controlling yarn package geometry and its density profile by electronically controlling, by a predetermined program, the tension on the yarn.

It is yet another objective of this invention to provide a novel beam configuration which has a greater beam aspect ratio than prior art beams while permitting dyeing of greater amounts of yarn without increasing amounts of blowout of the beam during liquor dyeing.

It is still another objective to improve the consistency of K/S values across the length of a beam by progressively increasing tension along the length of the beam.

These and other objectives of this invention will become apparent from the detailed description of the invention which follows, taken in conjunction with the accompanying drawings.

BRIEF SUMMARY OF THE INVENTION

Directed to achieving the foregoing objectives and to overcoming the problems in achieving adequate control of the geometry of yarn packages, the method according to the invention described in the parent application includes a step of programming the winding of yarn to achieve a desired geometry, including density profile. In a preferred embodiment, the method includes the step of controlling the tension on a yarn during winding by an electrical or electronic apparatus such as an electromagnetic tensioner, according to a predetermined sequence to achieve a predetermined density profile. Another aspect of the method according to the invention includes the step of relating the electrical voltage applied to a variable electronic tensioner such as an electromagnetic tensioner for tensioning yarn during winding according to a sequence related to time, thus to produce a yarn package which has a variable density profile which varies with the radius of the wrapped yarn from the core. Preferably, such a profile includes an arrangement whereby the density is a continuous function of the radius of the wrap of yarn from the outer diameter of the core. A presently preferred density profile includes a region near the core which is relatively less dense to permit significantly improved dye liquor flow, merging into a region which is relatively more dense in the central region of the package to provide desired strength and geometry to the yarn package, merging continuously into an outer region which is still more dense. Other profiles are possible.

An apparatus according to the invention described in the parent application and suitable for use in beam dyeing as well includes a precision winding apparatus having a means for tensioning yarn traveling from a yarn source of supply, such as a supply reel, the tensioning means including an electrical or electronic apparatus which is variably controllable according to a predetermined program or sequence to control the tension on the yarn during wrapping by the precision winding apparatus. By variably controlling the tensioning of the yarn, such as by a variably controlled electromagnetic tensioner, the package geometry and the density of the yarn wrap can be controlled.

The invention is also applicable to beam dyeing by progressively increasing warping tension on yarn as it is wrapped about a beam. The side-to-side tension is maintained uniform as is conventional. By this technique, improved K/S values are produced. Only beams having an improved geometry, and in particular an improved aspect ratio are enabled by the invention. Accordingly, such beams and beams wrapped for dyeing by the method from additional aspects of the invention.

These and other features of the invention will become apparent from the detailed description of the invention which follows taken in conjunction with the accompanying drawings.

BRIEF DESCRIPTION OF THE DRAWINGS

In the Drawings:

FIG. 10A and 10B shows a comparison of K/S values for a uniform tension across an along the length of a beam compared to the improved K/S values for progressively increasing tension along the length of the beam.

DETAILED DESCRIPTION OF THE PREFERRED EMBODIMENTS

Figure 1:
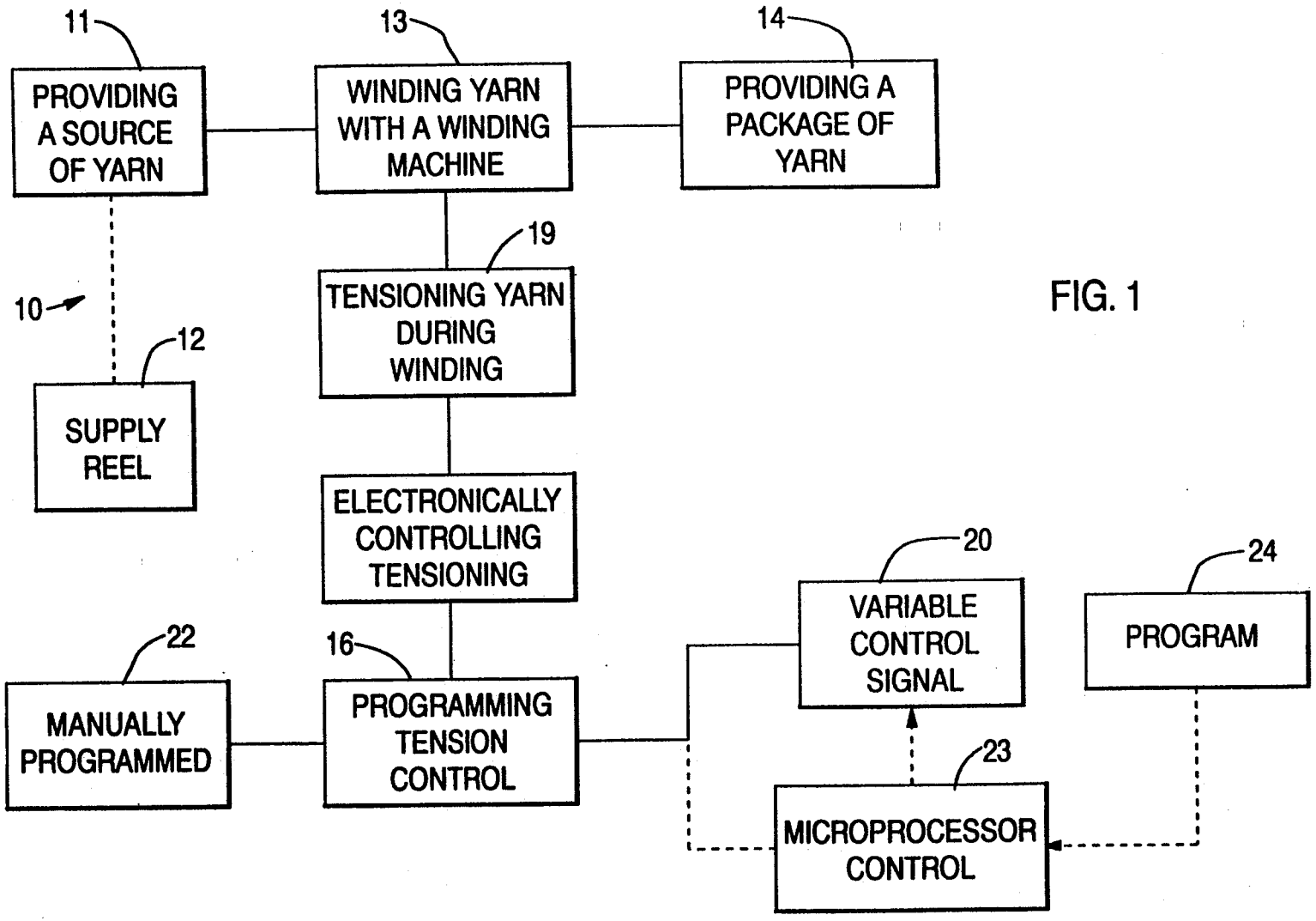
FIG. 1 is a block diagram of the steps of the method according to the invention.

FIG. 1 illustrates, in block diagram form, the method according to the invention as designated by the reference numeral 10. The method 10 includes an initial step 11 of providing a source of yarn, such as from a supply reel 12 on a winding machine. The yarn thus provided is wound in a winding step 13 to provide an improved wound package of yarn at the step designated by the reference numeral 14. The winding step 13 may be performed by either random winding, or by precision winding, by machines which are known to the art.

According to the invention, the winding step 13 is programmed, as indicated at the step 16, to control a step of electrically or preferably electronically controlling the winding step, as indicated in the step 18. In a preferred embodiment of the method, the step of controlling is performed by controlling the step of tensioning 19 on the yarn provided in the step 11 at a suitable location in the practice of the winding step 13 by an electronic tensioning device. By providing a variable control signal to the electronic tensioning device, as shown in the step 20, either manually such as in step 22, or from a programmed source, as in step 24, the tension applied to the yarn during winding is effectively controlled to produce a package of yarn having a density which varies in the package according to a predetermined pattern. The programmed source for the control signal may alternatively include a microprocessor 23 which is programmed by a diskette, for example, to output from a suitable voltage source, for example, a voltage signal which varies as a function of time according to the predetermined program. A suitable apparatus for the practice of the invention, as will be discussed in connection with FIGS. 2–8, is a precision winder such as is available from Scharer having its mechanical tensioner replaced by a variably-controlled electronic tensioner, such as is available from Appalachian Electronic Instruments, Inc., Ronceverte, W. Va. and shown for example in U.S. Pat. No. 4,313,578 which is incorporated by reference for completeness of disclosure.

A main feature of the method of the invention resides in its ability to control the density of the yarn package so wound by controlling the tension on the yarn during the winding process. In a specific example of practicing the method of the invention, the voltage applied to the variably-controlled tensioner is gradually or stepwise increased as the yarn package builds up. Thus, an important aspect of the invention is its recognition that the density profile of the yarn package can be controlled by controlling the tension by steps 16, 18 and 19 on the yarn during the winding step 13. When the density is thus controlled, the geometry of the yarn package is also controlled, as is its density profile.

In a specific application of the invention to a precision winder from Scharer, the yarn from the feed package was overfed to neutralize the tension of the feed package to a level below 5 grams of tension as measured on a Rothschild tensionmeter. Preferably, the feed yarn is overfed in a range up to 200% of the normal machine speed, but most preferably the overfeed rate is between 120 and 150% of the normal machine speed. The overfeeding device could be mechanical, but preferably is electronically controlled to permit programming the overfeeding during the winding operation. In practice, the tensioning program takes into account other mechanical features of the winding machine to which it is applied that affect the tension on the yarn. For example, in the Scharer system PSM-21, the tension on the yarn is increased mechanically as the take-up yarn package grows. This feature is known in the art as "back pressure reduction" and is controlled by the settings of the mechanical system which cannot be automatically changed while winding. As a specific example of the practice of the invention with a Scharer PSM-21 winding machine retrofitted with an Appalachian electromagnetic tensioner (EMT), an EPROM was connected to the EMT and monitored by a voltmeter. By keeping the tension constant and adjusting the voltage by hand, such as is shown in step 22, through a knob on the EPROM, yarn packages were successfully wound at respective tensions of 5, 10, and 15 grams at respective radial distances of 2, 4, and 6 cm. from the perforated core tube to produce a yarn package having a variable density with the least dense region near the core. Thus, a principal feature of the method of the invention recognizes that a programmed relationship between a control signal applied to an electronically controlled device, such as an EMT, applied to a winding machine, produces a wound yarn package having a variable tension which varies with the radius of the yarn package as measured from the outer diameter of the core tube.

Figure 2:
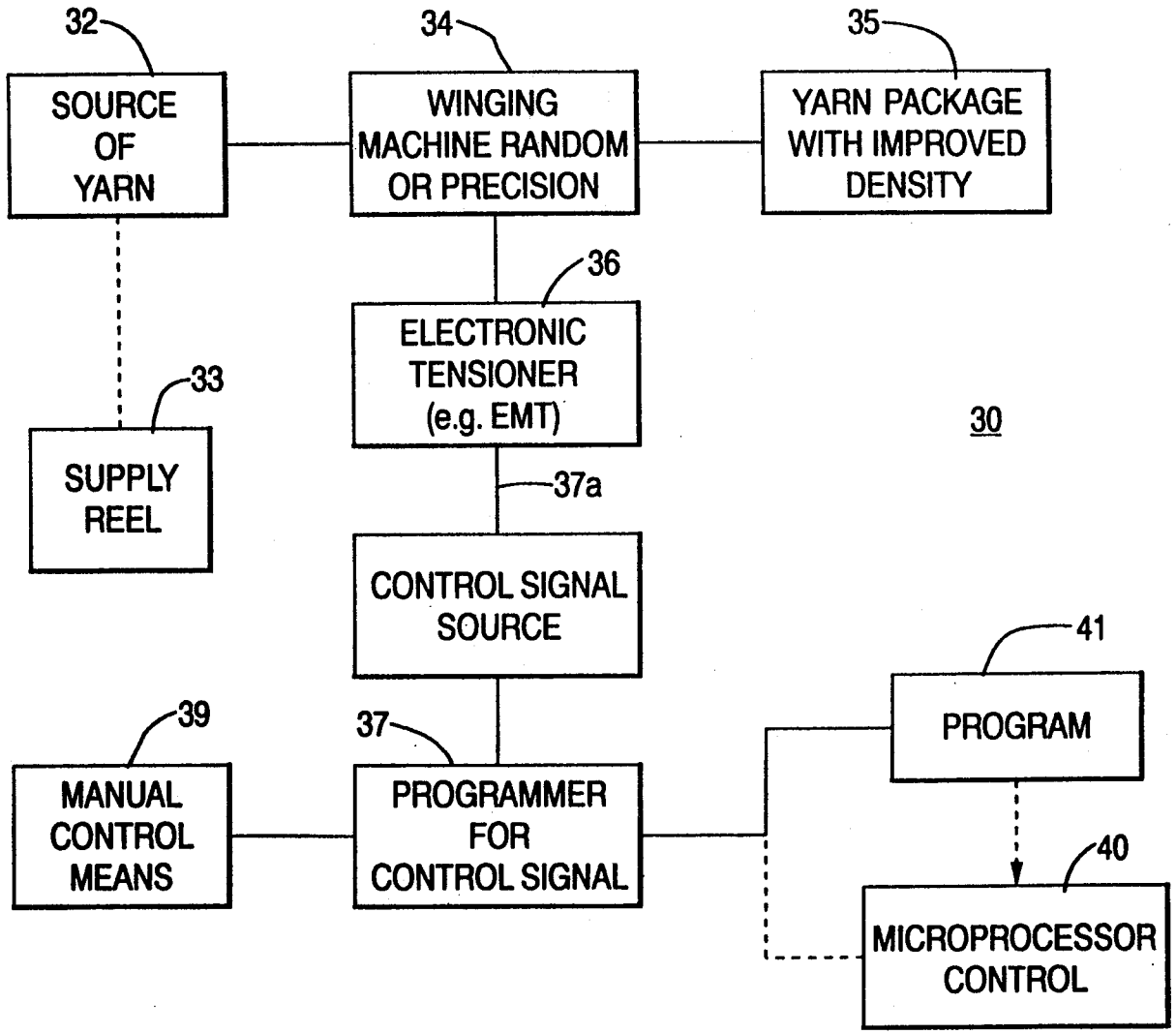
FIG. 2 is a schematic block diagrammatic view of the controlled electronic programmable apparatus according to the invention for practicing the method of the invention.

FIG. 2 is a representative block diagram of the components of an apparatus for practicing the method of the invention as shown generally at a reference numeral 30. A source 32 of yarn, such as a supply reel 33, provides yarn to a winding machine 34, such as one of those of the type described. An electromagnetic tensioner 36, such as the one described above, provides tension on the yarn while it is being wound onto an improved yarn package 36 according to the invention. The electromagnetic tensioner 36 is controlled by a control signal 37 produced from a programmed source 38 controlled by a programmer 37, such as a manual source 39, or a program 41, or a computerized source such as a microprocessor 40 operating according to the program 41, to provide a predetermined control signal 37 for varying the tension exerted on the yarn by the EMT 36. The apparatus may be provided as a part of the original winding equipment, or as a retrofitted device replacing the mechanical tensioner normally provided on a winding machine. The control signal source 38 thus provides a programmed sequence of electrical control signals to the electronic tensioner 36 as controlled by the programmer 37. For the particular EMT described, the control signals are voltage signals.

Figure 3:
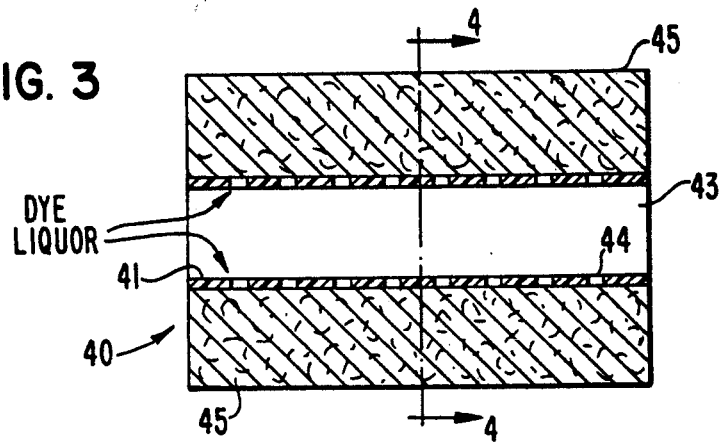
FIG. 3 is a side cross-sectional view of a typical yarn package showing yarn wound about a core, according to the invention.
Figure 4:
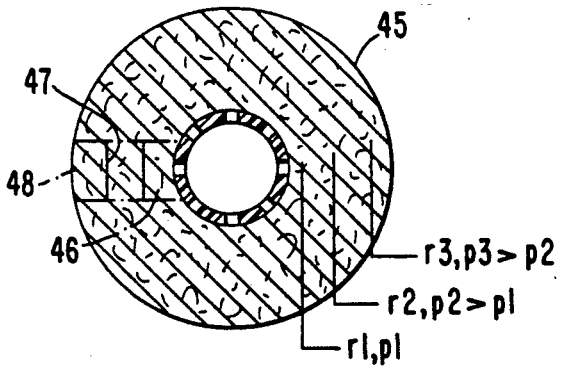
FIG. 4 is a cross-sectional view taken along line 4—4 of the yarn package of FIG. 3 showing a density variation in the packaged yarn as a function of the radius of the wound yarn.

FIG. 3 is a side cross-sectional view of a yarn package 40, having a perforated core tube 41, about which yarn 42 is wound by the winding machine 34. For use in the dyeing of yarn, as is well known, the core tube 41 is perforated in various shapes 44 to provide a flow path for dye liquor from the interior 43 of the tube 41 through the perforations 44 and then through the yarn 42 packaged about the tube in a predetermined pattern, as is known in the art. The dye liquor exits the yarn 42 at its outermost diameter 45 to return to be recirculated in the dyeing machine (not shown). FIG. 4 shows a side cross-sectional view taken along line 4—4 of FIG. 3, illustrating a significant feature of a yarn package produced according to the invention. That feature is that the density of the yarn, as measured from the inside of the yarn package, varies as a function of the radius of the yarn from the outer diameter of the core tube. FIG. 5B shows a representative family of curves of the density profiles in the yarn 42 as packaged according to the invention.

In producing an improved package of yarn according to the invention, for a typical yarn, it is desired to have a region 46 nearest the core tube 41 with a lesser density, continuously merging into a region 47 having a greater density about in the middle of the yarn package, finally merging into a region 48 of still greater density near the outermost diameter 45 of the yarn. With such a density profile, the geometry of the yarn package can be controlled significantly, while producing a yarn package which has significant advantages in the dyeing process. For example, with such a package, the flow of dye liquor in the region 46 most adjacent the core tube 41 is improved, better assuring a smooth and even flow of dye liquor through the yarn package as a whole and specifically through the adjacent regions 47, 48. Thus, the dyeing process is improved and consistent quality dyeing is better assured than with yarn packages to which little or scant attention has been paid to the package density. As indicated in FIG. 4, the density of the yarn 42 is least near the core tube 41 and greatest near the outer diameter 45 of the yarn. However, for specific applications, other density profiles can be developed following the same principles in the invention.

Figure 5A:
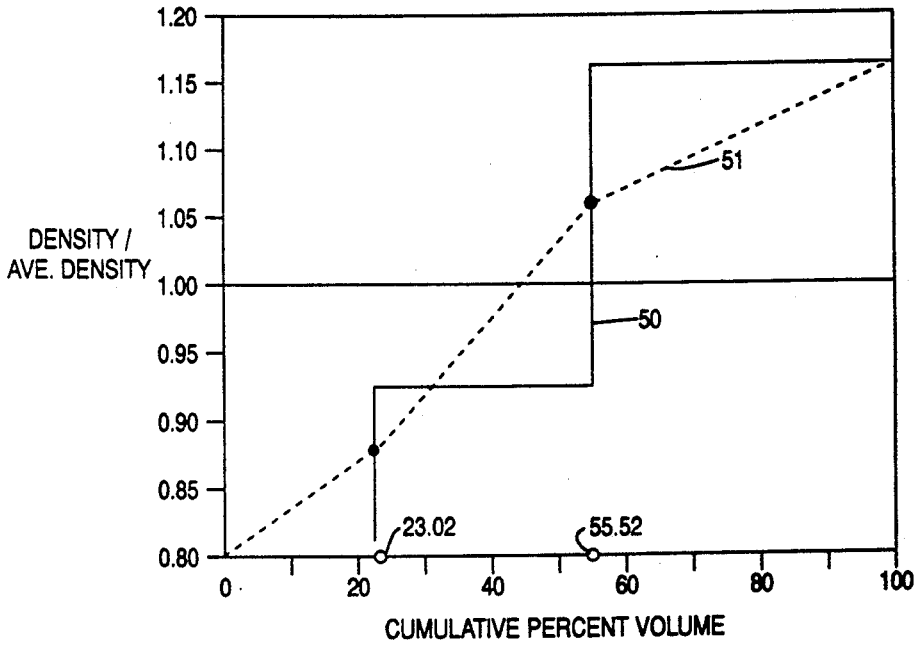
FIG. 5A shows a representative profile of yarn density as measured from the inside of the core.
Figure 5B:
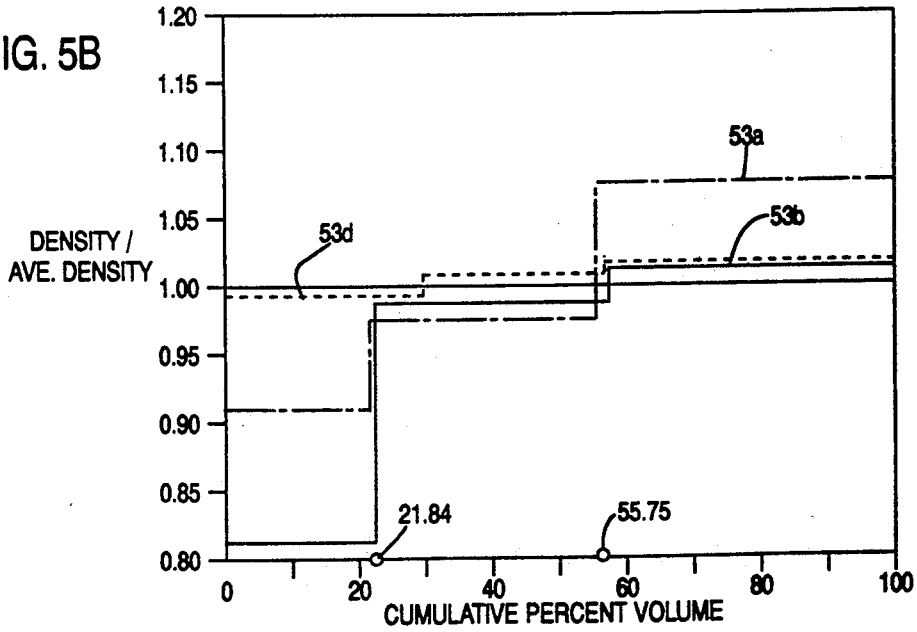
FIG. 5B is a family of curves showing alternative representative densities programmed into the wound yarn for various reasons.

FIG. 5A shows a typical density profile at curve 50 in a yarn package made according to the invention. By sampling the yarn package at three discrete locations in the package and knowing the mass of the package at that location and its volume, the density can readily be calculated. FIG. 5A thus shows a plot 50 of the observed data. It should be understood that the density varies continuously through the radius of the yarn on the core, not discretely as the sampling technique might erroneously suggest. Thus, curve 51 is a projected extrapolation of the actual density variation as a function of radius.

FIG. 5B shows a family of curves of density profile that can be obtained according to the invention. By recognizing the relationship between tension and the density profile, the geometry and density characteristics of the yarn package can readily be preprogrammed to achieve the desired profile, taking into account the intended end use of the yarn, the type of yarn and its shrinkage characteristics, for example, and the wrap profile on the core tube, among other factors. Thus, FIG. 5B should be considered as representative of a family of density profiles 53*a*, 53*b* and 53*c* that can be obtained with the invention. The density profile of a conventionally wound package as shown at curve 53*d*, demonstrates the improved results.

Figure 6:
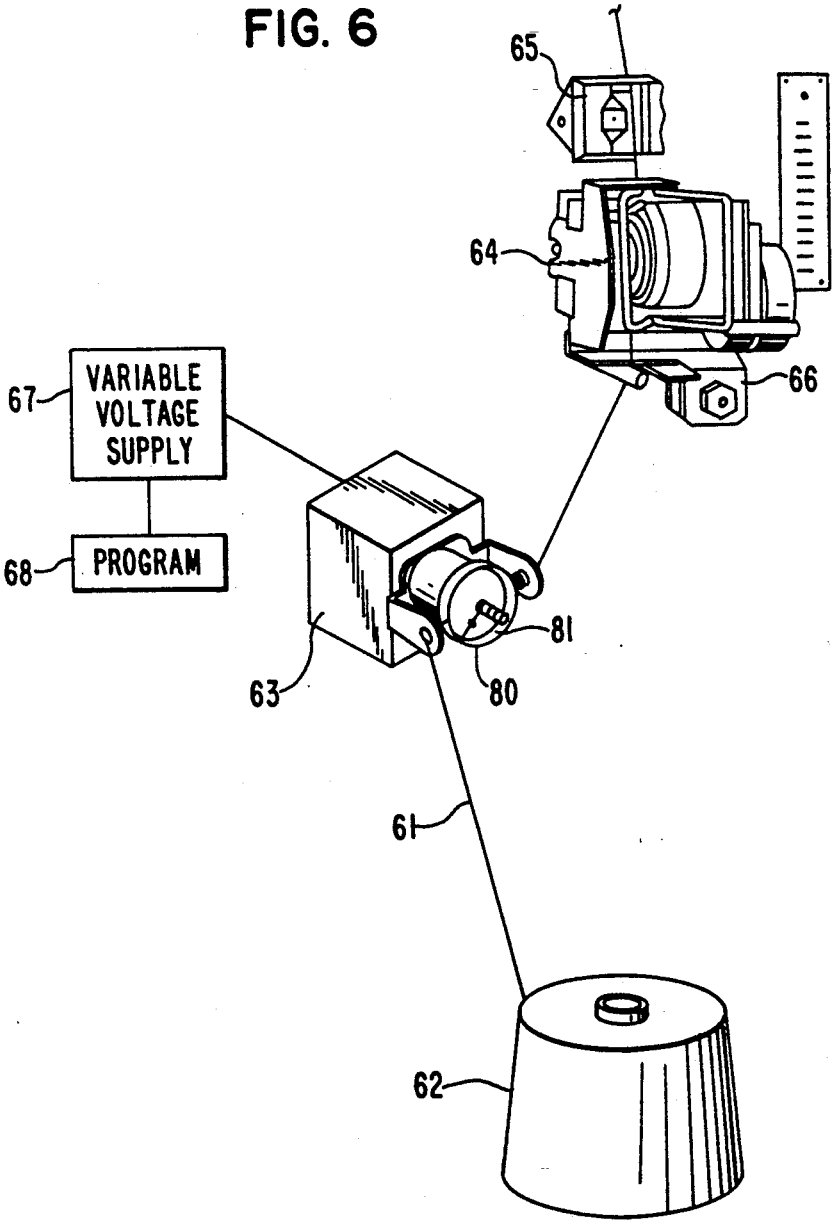
FIG. 6 is an illustration of a portion of a prior art precision mechanical winding machine showing a preferred embodiment of a programmed electromagnetic tensioner applied to the machine in place of its mechanical tensioner.

FIG. 6 shows a portion of a Scharer PSM-21 precision winder, the details of which are well known to the art and described in an instruction manual which is hereby incorporated by reference for completeness of disclosure of a precision winding machine to which the invention is applicable. As shown in FIG. 6, the yarn 61 is taken from a supply package 62 to an electromagnetic tensioner 63 of the type described, shown generally at the reference numeral 62 and then through a pre-clearer 63, a yarn brake 64 and a yarn stop motion device 65; to be wound on a takeup package (not shown). Such a machine is supplied with a balloon controller at the location at which the EMT is preferably provided. A variable voltage source for the EMT is shown at the block 67, under the control of a programmed source 68, as described more generally in connection with FIGS. 1 and 2. FIG. 6 thus illustrates a preferred embodiment of the application of hardware for the practice of the invention.

Figure 7:
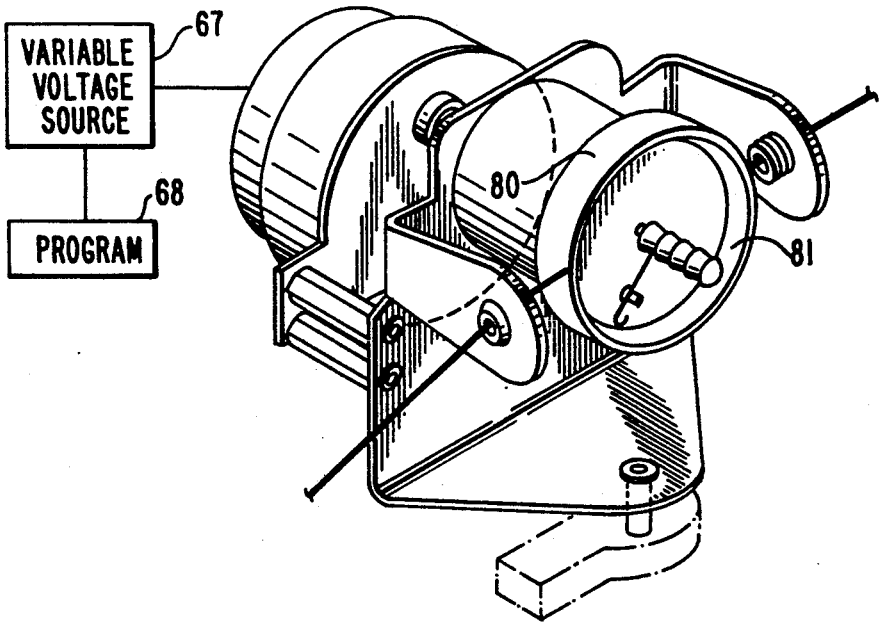
FIG. 7 is an illustration of a pertinent portion of a variably-controlled electromagnetic tensioner known to the art which is suitable for use with the embodiment of FIG. 6.

FIG. 7 is a perspective view of a portion of the EMT 67 shown in FIG. 6, taken from FIG. 8 of U.S. Pat. No. 4,313,578 which was discussed above. The yarn 61 passes through the discs 80 and 81 on which the tension is variable according to the control signal provided to the EMT 67 in accordance with the capabilities of that device.

Figure 8A:
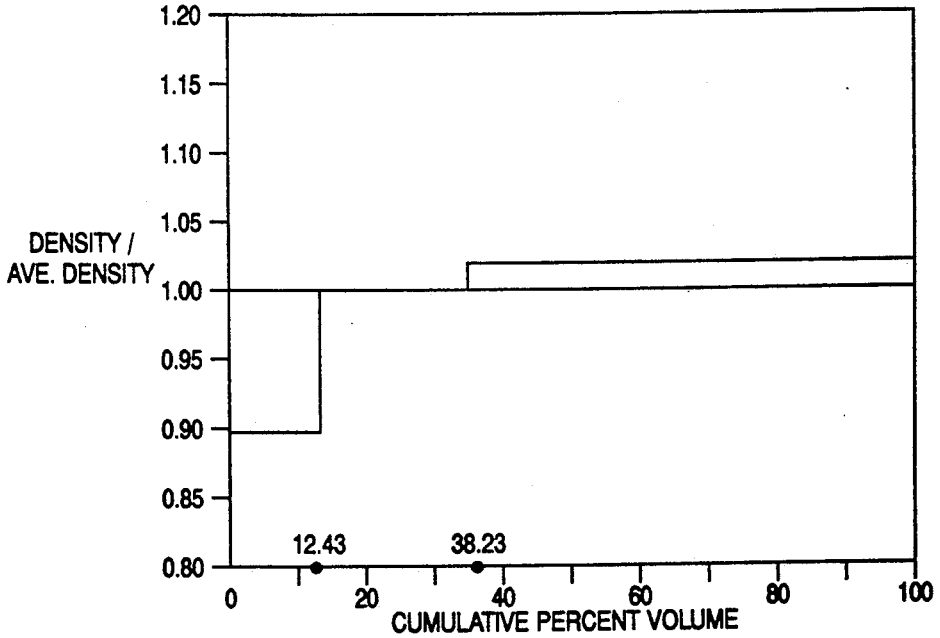
FIG. 8A–8C shows in graphic form a representative array of voltages, time, and resulting densities for a representative yarn package produced according to the invention.
Figure 8B:
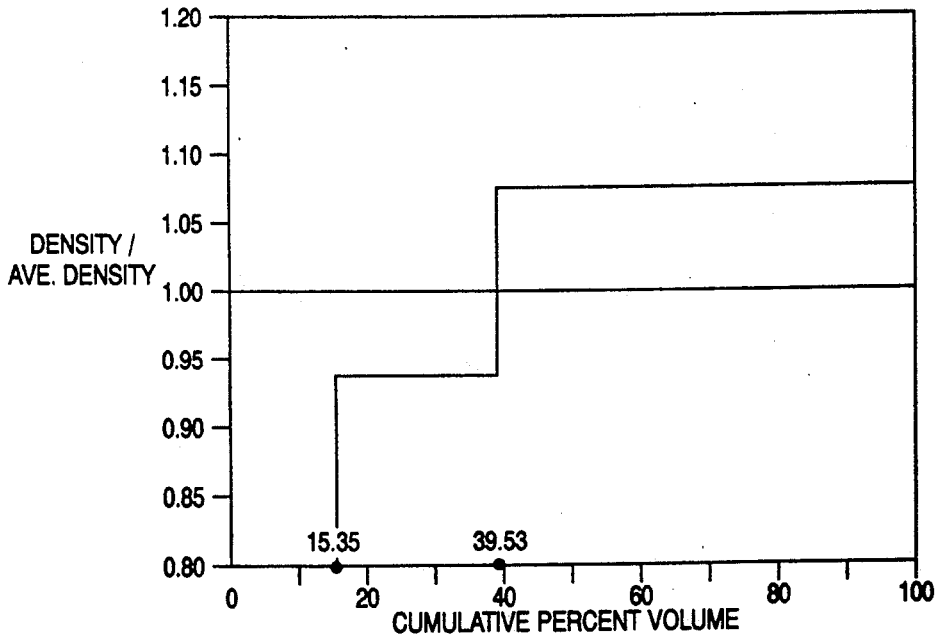
Figure 8C:
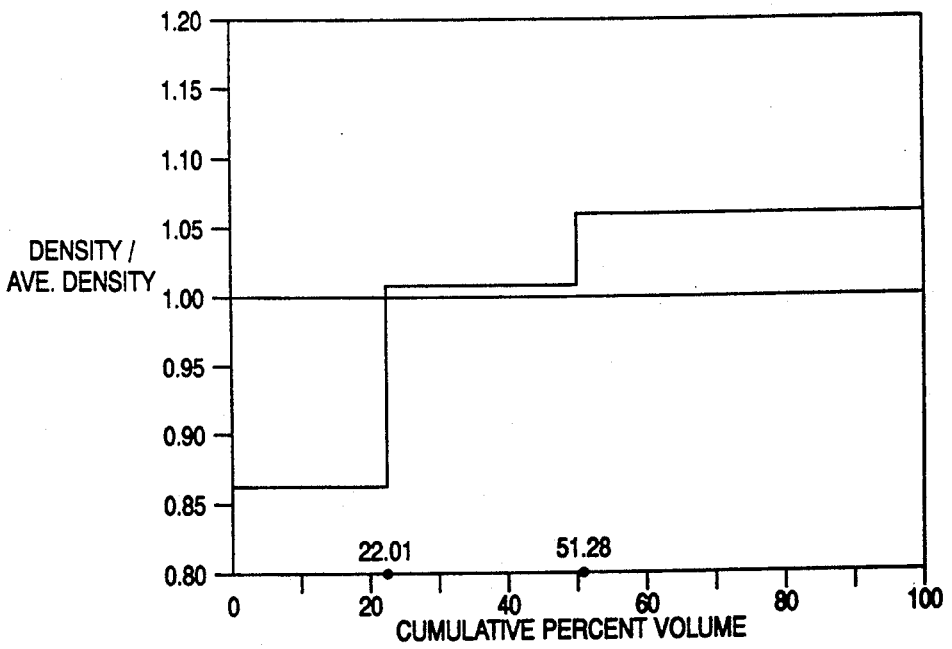

FIG. 8A–8C shows a representative array of voltages, times, and resulting densities for a representative yarn package produced according to the invention using the apparatus of FIGS. 6 and 7.

Figure 9A:
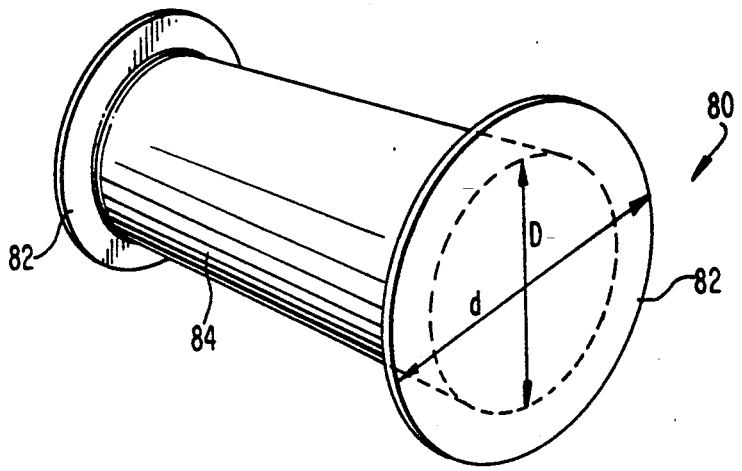
FIG. 9A PRIOR ART
FIG. 9 shows in FIG. 9A a prior art beam with typical dimensions as compared to the improved beam geometry permitted with the invention as shown in FIG. 9B.
Figure 9B:
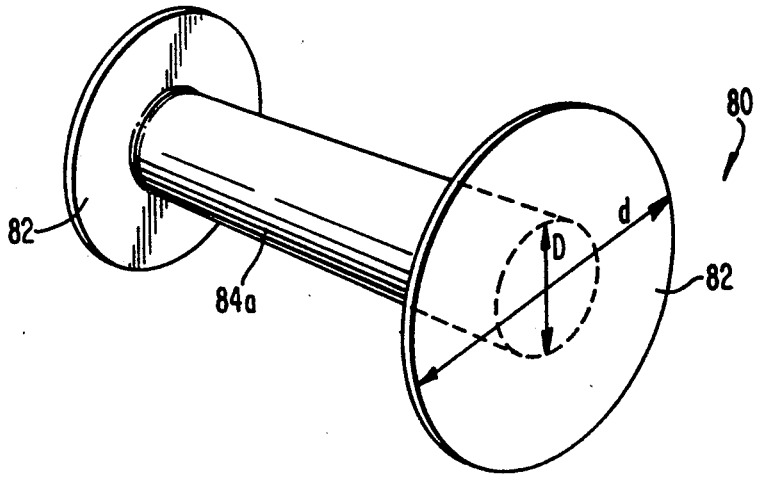

FIG. 9 shows a perspective view of a typical industrial section beam in FIG. 9A at the reference numeral 80. The beam 80 has a diameter of about 31 inches at the outside flange 82, a diameter of its core 84 of about 23 inches, and a width between flanges 82 of about 56 inches, resulting in a maximum yarn weight of about 275 pounds. The ratio of the outside diameter to the core diameter in the production size beam shown in FIG. 9A is about 1.35. Application of the teachings of the invention to beam dyeing resulted in the ability to significantly reduce the beam core diameter to thus increase its aspect ratio to about 3.46 in the laboratory without blowout.

The process of beaming while maintaining uniform tension across the beam is achieved with existing technology as described in U.S. Pat. No. 3,381,880 to White or the patent to Wilson described above. In the novel improvement to beam dyeing using the principles of controlled electronic programmable winding, the uniform tension across the width of the warp of the beam 80 is progressively increased as the yarn is warped around the beam. The process and its resulting improvements have been demonstrated in a laboratory setting using laboratory scale beams having an aspect ratio of 3.46. It should be noted that a laboratory beam that has a ratio of 1.35 as in the prior art beam 80 would accommodate only 650 yards of yarn 23/2 cotton count made of 100 per cent cotton, whereas the experimental laboratory beam with its 3.46 aspect ratio easily handled 2000 yards of the same yarn.

The table in FIG. 10A and 10B illustrates another advantage of using a progressively increasing warping tension. In the table, a first dyeing consisted of a warp wound at a uniform tension of 24 grams from the beginning to the end of the laboratory beam having an aspect ratio of 3.46. The other dyeing was performed on a warp wound with a progressively increasing tension along the length of the beam, while maintaining a uniform tension across the width of the beam. The tension started at 20 grams and ended at 30 grams using the same yarn and the same size beam. FIG. 10 thus reports the K/S values which represent quantitative color values derived from the Kubelka-Munk equation, representing the color value of these yarns at various positions within the beams dyed with a critical dye identified as Color Index Vat Blue 6.

The data support the conclusion that by progressively increasing the tension along the length of the beam 80, the maximum difference in color across the width of a dyeing is within the perceivable difference to the human eye which is considered to be around 5 per cent. As seen in FIG. 10B, the maximum difference in color between one dyeing and its replicate is about 5.5 per cent, while the maximum difference within one dyeing is about 5 percent. On the other hand, in K/S values for the beam that was warped with a uniform tension across and along the length of the beam, the difference is about 19.7 per cent 15 yards from the core of the beam, 32.5 per cent at the 1000 yard mark, and 12.5 per cent at the 1950 yard mark. These color differences within the beam are highly objectionable and would result in a color devaluation in the woven fabric.

A beam thus wound was satisfactory from the standpoint of dye liquor channeling and blowout. Thus, the new geometry of a dyeing beam permitted when the beam is wound by progressively increasing the tension along the length of the beam while maintaining uniform tension along the width of the beam significantly improves the production capability of the beam dyeing effort, without sacrificing efficiency due to blowout or channeling. Suitable variations in the ranges of increase as related to various types of fabric are expected to be noted empirically with additional studies.

While this invention has been described in conjunction with specific embodiments thereof, it is evident that many alternatives, modifications and variations will be apparent to those skilled in the art, particularly to alternative tensioning controls and programs therefor, and to various empirically derived ratios for both winding and for beam dyeing. Accordingly, it is intended to embrace all alternatives, modifications and variations that fall within the scope of the appended claims.

What is claimed is:

1. A method for winding yarn for dyeing on a beam, comprising:

providing a beam having a core about which yarn to be dyed is to be wound; and winding said yarn on said beam initially at a substantially uniform pre-determined low tension across the width of said beam and progressively increasing warping tension on said wound yarn as the diameter of the yarn on the beam increases, whereby beam core diameter may be reduced and improved uniformity of dyeing of said yarn may be obtained.

2. The method as set forth in claim 1, further including a step of dyeing said yarn while warped on said beam without blowout or channeling of dye liquor through said wound yarn.

3. The method as set forth in claim 2 wherein said dyeing step is carried out while maintaining a K/S value on the order of 5 per cent or less across the width of the beam for the length of yarn warped on said beam wherein said K/S value as measured by a spectroscope equals the coefficient of absorption divided by the coefficient of scatter.

4. The method as set forth in claim 1 further comprising a step of shaping said beam with an aspect ratio of flange diameter to core diameter greater than about 1.35.

5. The method as set forth in claim 4 further comprising the step of shaping said beam with an aspect ratio on the order of 3.46.

6. A method for improving dye liquor distribution and for eliminating blow-out in a dyeing beam, comprising the steps of:

warping yarn at an initial uniform and pre-determined low tension across said beam;

increasing progressively warping tension as the diameter of the yarn on the beam increases, thus to produce a dyeing beam of thus-wound yarn; and passing dye liquor through said wound yarn without significant channeling and without blowout.

* * * * *